United States Patent [19]

Guilcher et al.

[11] 4,261,631

[45] Apr. 14, 1981

[54] CONNECTOR FOR PRINTED CIRCUIT BOARD

[75] Inventors: Bernard Guilcher, Morlaix; Julien Jonchere, Runrouz; Georges Thiebaut, Louannec, all of France

[73] Assignee: Compagnie Industrielle des Telecommunications Cit-Alcatel, Paris, France

[21] Appl. No.: 35,188

[22] Filed: May 2, 1979

[51] Int. Cl.[3] ..... H01R 13/20

[52] U.S. Cl. ..... 339/75 MP

[58] Field of Search ..... 339/74 R, 75 MP, 176 MP

[56] References Cited

U.S. PATENT DOCUMENTS

| | | | |
|---|---|---|---|
| 3,553,630 | 1/1971 | Scheingold et al. | 339/74 R |
| 3,858,957 | 1/1975 | Harwood et al. | 339/74 R |
| 3,899,234 | 8/1975 | Yeager et al. | 339/74 R |
| 4,152,037 | 5/1979 | Bonhomme | 339/75 MP |

FOREIGN PATENT DOCUMENTS

| | | | |
|---|---|---|---|
| 1125990 | 3/1962 | Fed. Rep. of Germany | 339/74 R |
| 2423266 | 12/1974 | Fed. Rep. of Germany | 339/75 MP |
| 1174063 | 3/1959 | France | 339/75 MP |
| 1480183 | 7/1977 | United Kingdom . | |

*Primary Examiner*—Joseph H. McGlynn

*Attorney, Agent, or Firm*—Sughrue, Rothwell, Mion, Zinn and Macpeak

[57] ABSTRACT

A connector comprises a base portion provided with contacts, a movable block and a device for displacing the movable blocks perpendicularly to the base portion, operation of the displacing device causing the movable block to take up a raised position in which it is possible to insert above the base portion a printed circuit board bearing contacts on one side facing the base portion, and a lowered position in which the printed circuit board is pressed against the said contacts provided on the base portion.

7 Claims, 12 Drawing Figures

CONNECTOR FOR PRINTED CIRCUIT BOARD

The invention relates to a connector for a printed circuit board, in particular a board which carries a large number of contacts.

BACKGROUND OF THE INVENTION

When there are a large number of contacts on a board, a certain amount of force is necessary for insertion and extraction of the board into and out of an edge connector. Attempts have already been made to reduce, or even to eliminate this force.

Connectors in which this force for insertion or extraction is eliminated are already known. One type of known connector includes two arms which are hinged at one of their ends, at least one of the arms being provided with contacts; a contact support member such as for example a male connector or a printed circuit board is introduced between the two arms which are subsequently brought together. There is no provision for guiding the insertion or extraction of the contact support member in such a connector, and above all it is difficult to obtain identical pressure on all the contacts which are spaced at intervals along one arm.

A connector in the shape of a U provided with contacts inside the U, on each one of the arms is also known. Such a connector includes means for displacing the contacts to the point where they meet with the contact support member which had been introduced between the arms of the U through the open end of the said U. In this type of connector it is not possible to insert a contact support member from one of its ends, said contact support member having to slide between the arms.

In the connector having two hinged arms it is possible to carry out introduction through the open end, but the opening up of the hinged arms which is necessary for insertion, causes this type of connector to be somewhat cumbersome and prevents its use in a rack carrying a large number of connectors.

AIMS OF THE INVENTION

The present invention has the aim of overcoming the disadvantages of known connectors and provides a connector which is compact and allows longitudinal or transverse insertion, or extraction, of a contact support member.

The present invention also has the aim of overcoming the disadvantages of known connectors and providing a connector which is compact and allows longitudinal or transverse insertion, or extraction, of a contact support member.

The present invention also has the aim of providing a connector in which insertion and extraction of a contact support member is carried out without mutual rubbing between the contacts occurring.

A further aim of the invention is to provide a connector which can be used at the opposing ends of a contact support member which is inserted longitudinally between the connectors.

The invention also has the aim of providing a connector in which it is possible to make connection onto three sides of a contact support member.

A further aim of the invention is to provide a connector in which the contact support member is locked in place in order to prevent it from being extracted when electrical contact has been established.

SUMMARY OF THE INVENTION

The present invention provides a connector comprises a fixed baseplate having a base portion provided with contacts, a movable block and a device for displacing the movable block in a direction which is perpendicular to the base portion, operation of the said displacing device causing the movable block to take up a raised position in which it is possible to insert a printed circuit board bearing contacts on one side facing the base portion without said circuit board contacts coming into contact with those of the base portion, and a lowered position in which the printed circuit board is pressed against the contacts provided on the base portion, the movable block carrying the printed circuit board with it as it moves.

BRIEF DESCRIPTION OF THE DRAWINGS

The invention will be better understood when reference is made to the description which follows of non-limiting embodiments, which are illustrated in the accompanying drawings in which.

DETAILED DESCRIPTION OF THE PREFERRED EMBODIMENT

Figure 1:
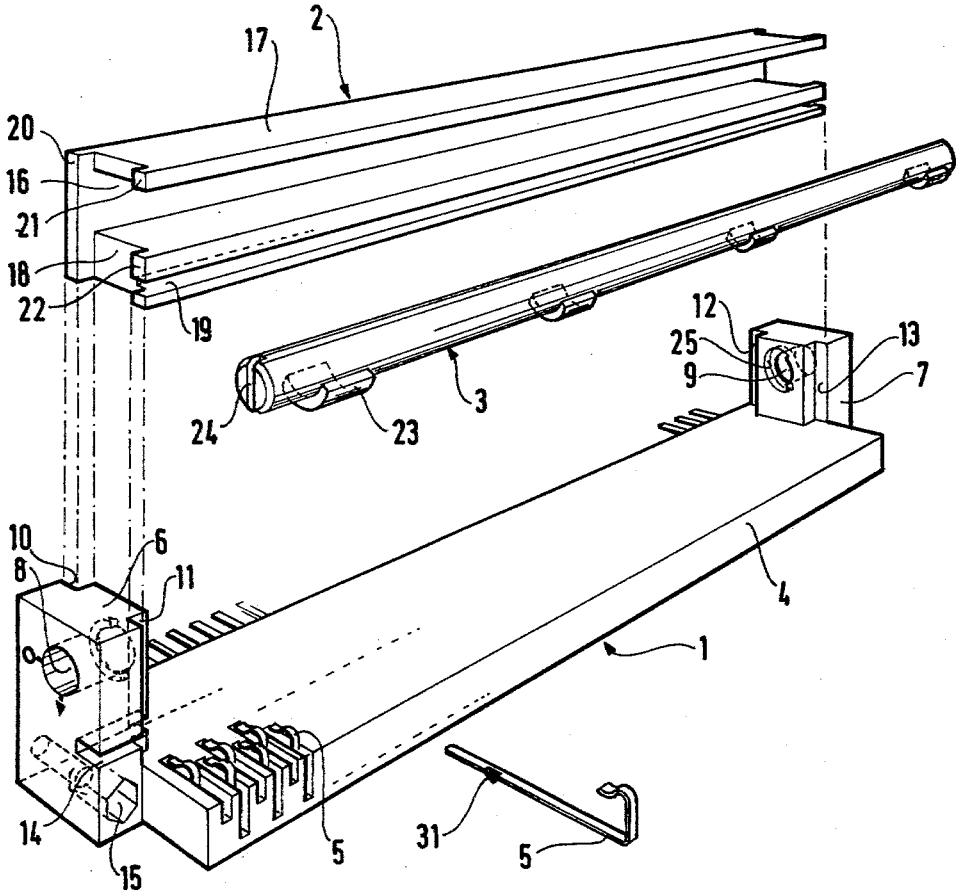
FIG. 1 is an exploded perspective view of one embodiment of a connector.

FIG. 1 shows one embodiment of a connector in accordance with the invention. It comprises a baseplate 1, a movable block 2 and a control shaft 3.

The baseplate 1 comprises a base portion 4, provided with detachable contacts 5 which are held in place in the baseplate by respective detents 31, and two uprights 6 and 7 having respective holes 8, 9, which receive one end of the control shaft 3. The sides facing each other of the two upwardly extending corner recesses, these being shown at 10 and 11 for upright 6, and 12 and 13 for upright 7. A slot 14 for insertion of a contact-bearing member 28, see FIGS. 2 and 3, is provided in one of the uprights, 6 for example, and passes through the upright a small distance above the base portion 4; the lower region of each upright also carries a hole 15 for fixing the baseplate in position.

The movable block 2, which is housed between the uprights 6 and 7, is generally U-shaped with a base 16, a first or upper arm 17, and a second or lower arm 18 which includes a longitudinal slot 19; the arms 17 and 18 are shorter than the base 16 which consequently has a projecting lip 20 at each end. The first arm 17 has a projecting peg 21 at each end and likewise the second arm 18 has a projecting peg 22 at each end. The projecting lip 20 engages in the corner recesses 10 and 12. The projecting pegs 21 and 22 engage in the corner recesses 11 and 13. Control shaft 3 is housed between the arms 17 and 18 of the movable block 2, and carries a plurality of cams 23, with a cam 23 located close to each end of of the shaft and other cams distributed along its length. When the control shaft is in place, its ends engage in the holes 8 and 9 provided in the uprights 6 and 7, and the cams located close to the ends of the control shaft each engage partially in a substantially semicircular housing 25 which is formed in the uprights 6 and 7. This housing has the purpose of limiting the rotation of the control shaft and can best be seen in FIGS. 2 and 3; the control shaft is provided with a slot 24 at one of its ends, so that it may be rotated.

Figure 2:
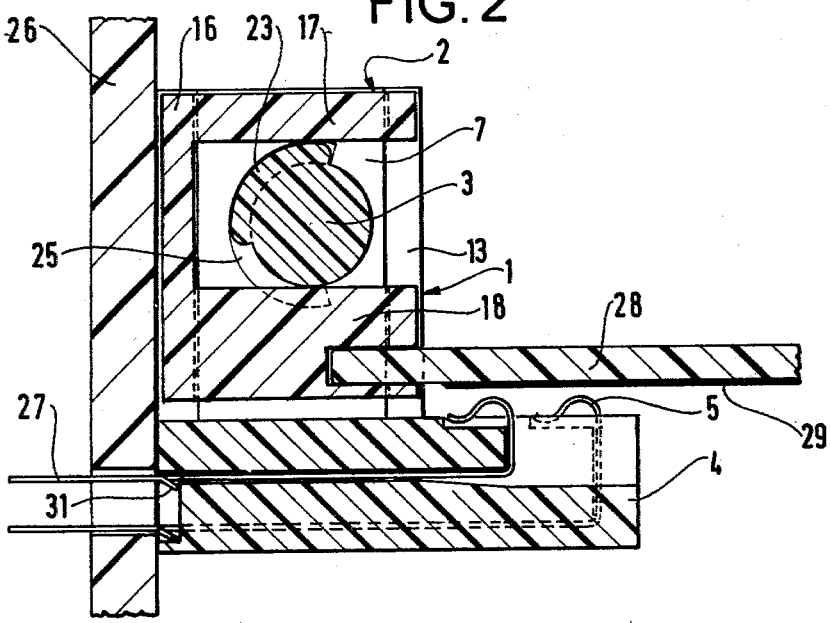
FIG. 2 is a cross-sectional view of the connector shown in FIG. 1.

FIG. 2 is a cross-sectional view of the connector shown in FIG. 1; the movable block 2 is in the raised position, cam 23 being in contact with the first or upper arm 17 of the movable block; in this figure it can be seen that the cam 23 at the end of control shaft 3 engages in the housing 25 formed in the upright 7 of the baseplate, the housing having the shape of a sector of a circle extending over slightly more than a semicircle; when the movable block 2 is in the raised position the cam abuts against one extremity of the substantially semicircular housing. The baseplate 4 is fixed onto a support 26, and the end portions 27 of the contacts pass through the support for connection purposes. The said end portions 27 include respective detents 31 which detachably fix the contacts into the baseplate; these end portions 27, or tails, of the contacts may have any desired shape so as to provide for connection by means of soldering, wire wrapping or by means of a cable connector which engages with the tails: as a consequence of the contacts being detachable, the baseplate 4 can be fitted with any given type of contact, and similarly contacts can be replaced if necessary. When the movable block is in the raised position, its longitudinal slot 19 is aligned with slot 14 (see FIG. 1) of upright 6, which makes it possible to insert a contact-bearing member 28, one end of which is first slid into slot 14 and then into slot 19; the contact-bearing member, which for example may be constituted by a printed circuit board, has contacts 29 in the form of metal contact pads. When the contact-bearing member 28 is inserted into the connector, it comes into abutment with the upright 7 of the baseplate, and is no longer engaged in slot 14 of upright 6; it is then possible to rotate the control shaft 3 so that the cams 23 press against the second or lower arm 18 of the movable block 2 which moves downwardly towards the base portion and takes up a lowered position which is shown in FIG. 3.

Figure 3:
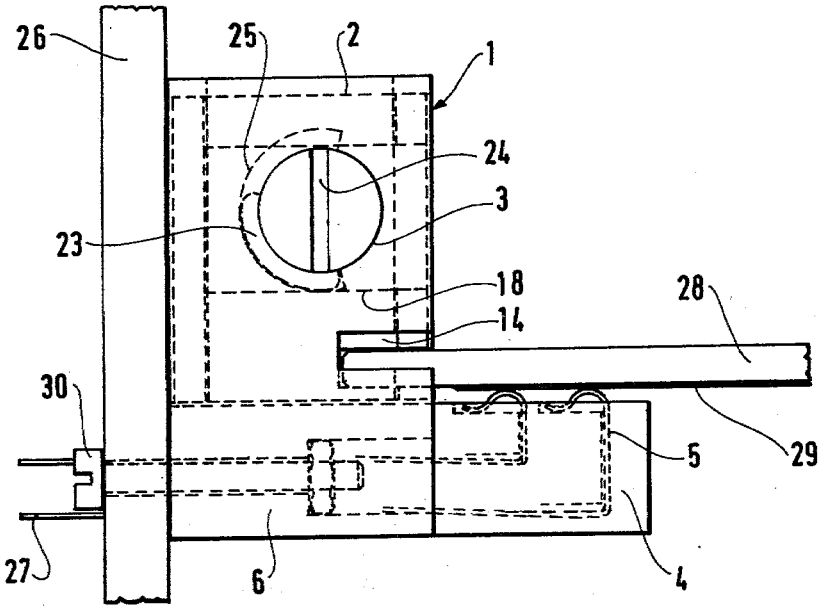
FIG. 3 shows the connector of FIG. 1 seen from its left hand end.

FIG. 3 shows the connector of FIG. 1 seen from its left hand end and fixed in position on the support 26 by means of bolts 30 passing into each of the uprights and engaging units held captive in the holes 15 (see FIG. 1). The movable block 2 is in the lowered position, with the cams 23 of the control shaft 3 pressing against the second arm 18 of the movable block and abutting against one extremity of the substantially semicircular housing 25. The housing 25 limits the rotation of the control shaft to define the raised position and the lowered position of the movable block when the cams 23 abut against one or the other of the extremities of the said housing 25. When the movable block 2 passes from its raised position to its lowered position, it carries the contact-bearing member 28 with it as it moves and the contact pads thereon come to a position where they press against the contacts 5 on base portion 4, leading to the establishment of electrical contact between each contact 5 and the corresponding contact 29.

In the lowered position, the slot 19 in the movable block is at a position where it is lower than the slot 14 in upright 6 so that it is not possible to extract the contact-bearing member 28 from the connector, this particular arrangement of slots 14 and 19 ensuring mechanical locking; it is necessary to bring the movable block back to the raised position in order to extract the contact-bearing member 28, and this breaks electrical contact between the contacts on the contact-bearing member and the contacts on the base portion. It is consequently possible to insert or extract a contact-bearing member without the contacts rubbing against those on the connector. Indeed this action needs no special precautions since the movable block guides the contact-bearing member when it slides into or out of the connector as a whole.

Figure 4:
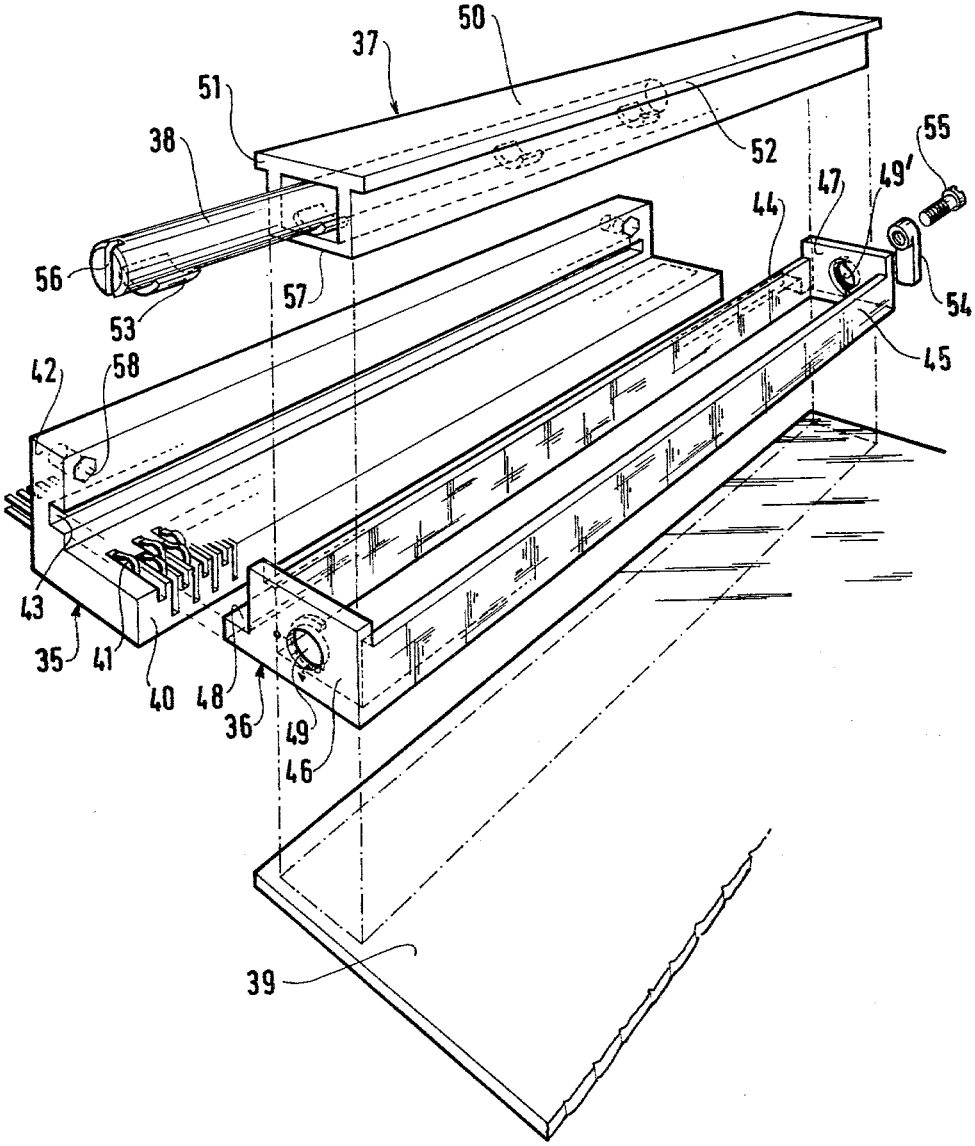
FIG. 4 is an exploded perspective view of a further embodiment of a connector.

FIG. 4 shows a further embodiment of a connector in accordance with the invention. The connector comprises a baseplate, 35 a fixed block 36, a movable block 37, and a control shaft 38.

The baseplate 35, which is L-shaped, is made up by a base portion 40 having contacts 41, which are identical to the contacts 5 of FIGS. 1,2,3, and by a wall 42 provided with a slot 43 which extends over the major portion of the length of the wall 42 and is closed at one end; holes 58 are provided in the upper portion of the said wall 42 for fixing the baseplate in position. The fixed block 36 has first and second side walls, 44 and 45 respectively, which are joined together at their ends by means of two uprights 46 and 47; the first side wall 44 includes a projecting part 48 which extends over the whole of its length; the uprights 46 and 47 have respective holes a hole 49,49' to receive the end portions of the control shaft 38. The movable block 37 is an elongated hollow member having a rectangular cross section comprising an upper wall 50 having two projecting lips 51 and 52 which extend over its whole length; the movable block is housed, with the control shaft 38 installed in its rectangular hollow portion, inside the fixed block 36, between uprights 46 and 47 and lying against side walls 44 and 45, with the projecting lips 51 and 52 of the movable block being located above the said side walls. The control shaft 38 is identical to the control shaft 3 shown in FIGS. 1,2, and 3 and consequently has cam 53 close to each end and cams 53 distributed over its length. Likewise when the control shaft 38 is located in holes 49 and 49' of the fixed block, the cams located close to the ends of the control shaft engage partially in respective substantially semicircular housings 64 provided in the uprights 46 and 47. A locking device 54 is fixed by means of a screw 55 to that end of the control shaft which is adjacent to the closed end of the slot 43. The other end of control shaft 38 is provided with a slot 56 so that it may be rotated. A printed circuit board 39 is fixed using any known means to the lower wall 57 of the movable block 37 when the latter is in place in the fixed block 36. The side of the printed circuit board opposite that which is fixed to the movable block, carries contacts 65 located beneath the said movable block (see FIGS. 5 and 6).

Figure 5:
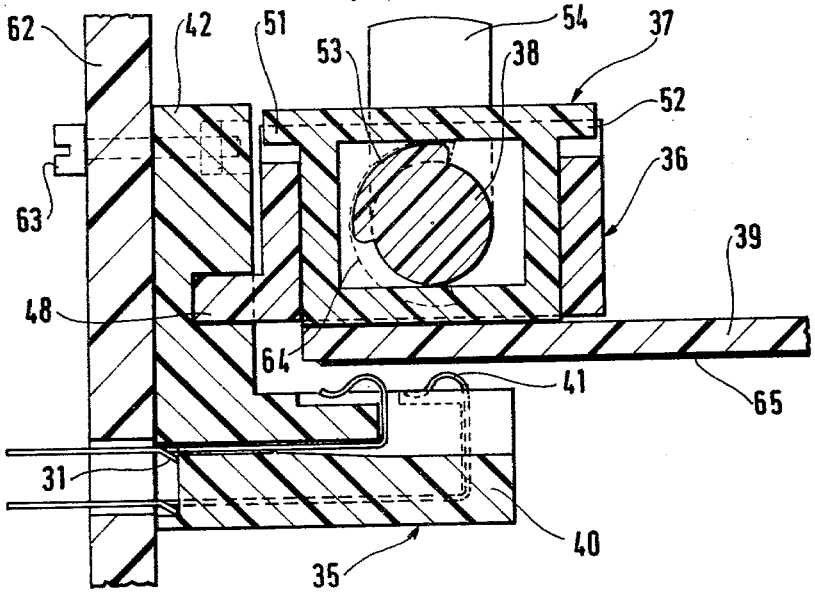
FIG. 5 is a cross-sectional view of the connector shown in FIG. 4.

FIG. 5 is a cross-sectional view of the connector shown in FIG. 4. The baseplate 35 is fixed onto a support 62 using bolts 63 engaging nuts held captive in the holes 58 (see FIG. 1). The position of control shaft 38 is such that the cams 35 cause the movable block 37 to take up a raised position with respect to fixed block 36, the cams 53 located at the ends of control shaft 38 are engaged in the substantially semicircular housing 64. As shown, the substantially semicircular housings extend over an arc of slightly more than 180°. The fixed block 36, the movable block 37 and the printed circuit board 39 constitute a contact-bearing member and the projecting sill 48 of the fixed block is introduced into the slot 43 provided in the baseplate until it comes into abutment with the end of the said slot. The control shaft 38 is then rotated and the cams 53 cause the movable block to become displaced perpendicularly to the base portion inside the fixed block and to take up its lowered position which is shown in FIG. 6.

Figure 6:
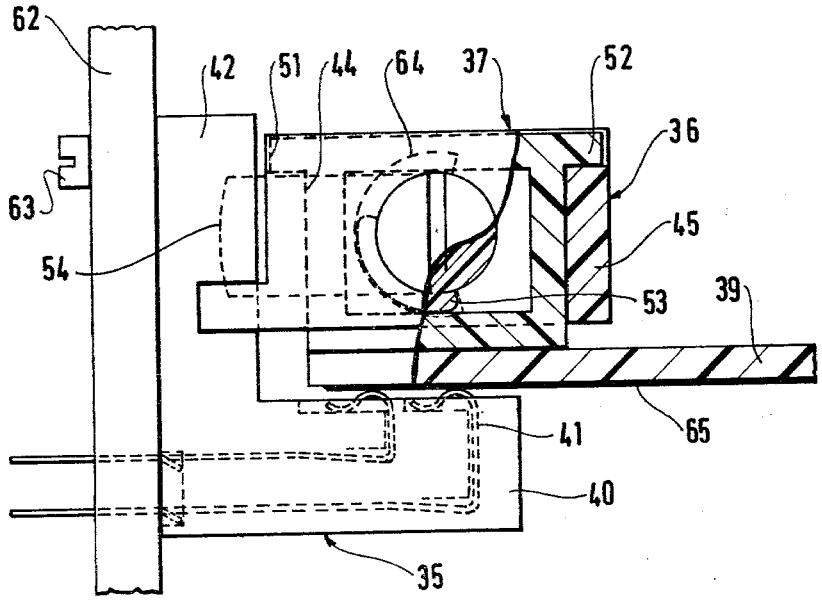
FIG. 6 shows the connector of FIG. 4 seen from its left hand end, partially in section.

FIG. 6 shows the connector of FIGS. 4 and 5 seen from its left hand end with the fixed and movable blocks partly in section, the movable block 37 being in the lowered position. The printed circuit board is pressed against the contacts 41 on the base portion thus establishing electrical contact between the contacts 41 on the base portion and the contacts 65 on the printed circuit board. As the locking device 54 has turned together with the control shaft it is now impossible to extract the contact support member since the said locking device is now in abutment with the end of the wall 42 of the baseplate 35. Extraction of the contact support member is only possible when the control shaft is rotated so as to bring the movable block to its raised position which causes the locking device 64 to turn and at the same time interrupts electrical contact, since the movable block carries the printed circuit board with it when it moves.

Figure 7:
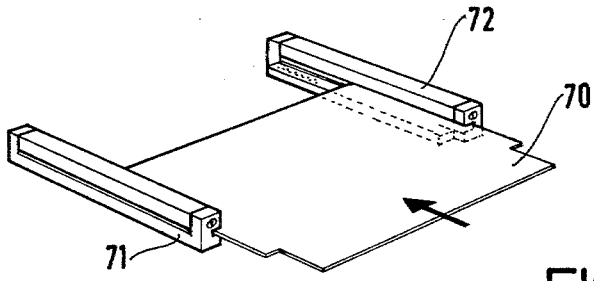
FIG. 7 shows the use of two connectors with one single contact support member.

FIG. 7 shows diagrammatically a contact-bearing member 70 introduced between two connectors 71 and 72, this contact support member having contacts at each of its ends. When a large number of contacts are present it is actually preferable to distribute these contacts over the two ends of the contact-bearing member instead of providing them at one end only, which would require the combined use of both a circuit board connector and of an additional connector having a large number of contacts. Connectors 71 and 72 may either be of the type shown in FIG. 1 or of the type shown in FIG. 4, insertion of the contact support member being in the longitudinal direction.

Figure 8:
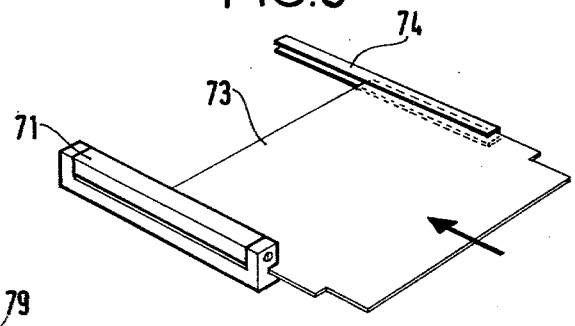
FIG. 8 shows the use of a connector with a printed circuit board.

FIG. 8 shows the use of a connector 71 with a printed circuit board 73 which has contacts at one end only. In order to facilitate positioning and insertion in the longitudinal direction of the printed circuit board, a conventional U-shaped slide plate 74 is used into which the printed circuit board slides. Connector 71 may either be of the type shown in FIG. 1 or of the type shown in FIG. 4.

Figure 9:
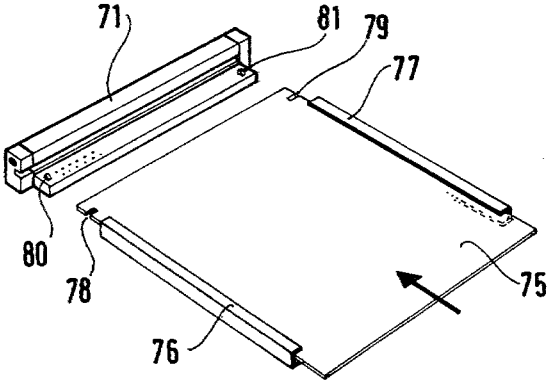
FIG. 9 shows transverse insertion of a contact support member into a connector.

FIG. 9 shows the use of a connector 71 in which a contact-bearing member such as a printed circuit board 75 is inserted directly without sliding along the slot 19 or 43. In contrast to the description referring to FIGS. 1 to 8, in which the contact-bearing member is inserted into the connector by sliding longitudinally, in FIG. 9 insertion is carried out by a broadside thrust into the slot in a direction perpendicular to the connector. This can be performed with either type of connector whether as shown in FIG. 1 or as shown in FIG. 4. The printed circuit board 75 slides inside two slide plates 76 and 77 and is inserted into the longitudinal slot 19 of the connector shown in FIG. 1, or into the slot 43 in the baseplate of the connector shown in FIG. 4.

In order to ensure that the printed circuit board is locked in place when electrical contact is established, the printed circuit board may have notches 78 and 79 with the baseplate of the connector being fitted with projections 80 and 81 to cooperate with the notches.

Figure 10:
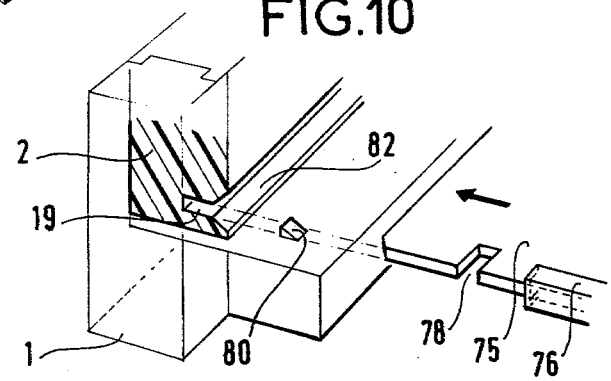
FIG. 10 shows one end of the connector in FIG. 9.

FIG. 10 shows one end of the connector and the printed circuit board of FIG. 9. A connector of the type shown in FIG. 1 is shown in this drawing. The longitudinal slot 19 in the movable block 2 has a chamfer 82 extending over its whole length in order to aid insertion of the printed circuit board 75. When the printed circuit board is inserted into the longitudinal slot, and the movable block 2 is in the lowered position, the projection 80 on the base portion engages with the notch 78 thus preventing extraction of the printed circuit board. It is obvious that the connector may be of the type shown in FIG. 4, and in this case slot 43 is chamfered in order to facilitate insertion of the projecting part 48 of the fixed block 36.

It is also possible to use three connectors, with a printed circuit board bearing contact on three sides; in this arrangement a third connector is provided between the connectors 71 and 72 in FIG. 7. The printed circuit board is inserted broadside into this third connector, as shown in FIG. 9, with the connectors 71 and 72, in which insertion is by sliding, acting as slide plates. In this arrangement, the connectors 71 and 72 lock the printed circuit board in place.

The connectors which have been described and illustrated can be arranged horizontally or vertically, as is the case with conventional connectors. The contact-bearing member may be a printed circuit board used by itself, or a flat male connector, located at one end of a printed circuit board as is used with conventional connectors. One of the advantages of the connector in accordance with the invention compared to known connectors is that it is possible to make connections with a printed circuit board which has contacts arranged either at two opposite edges or at two adjacent edges, or even at three edges, the connectors being fixed into a frame and insertion being carried out in one single operation.

Figure 11:
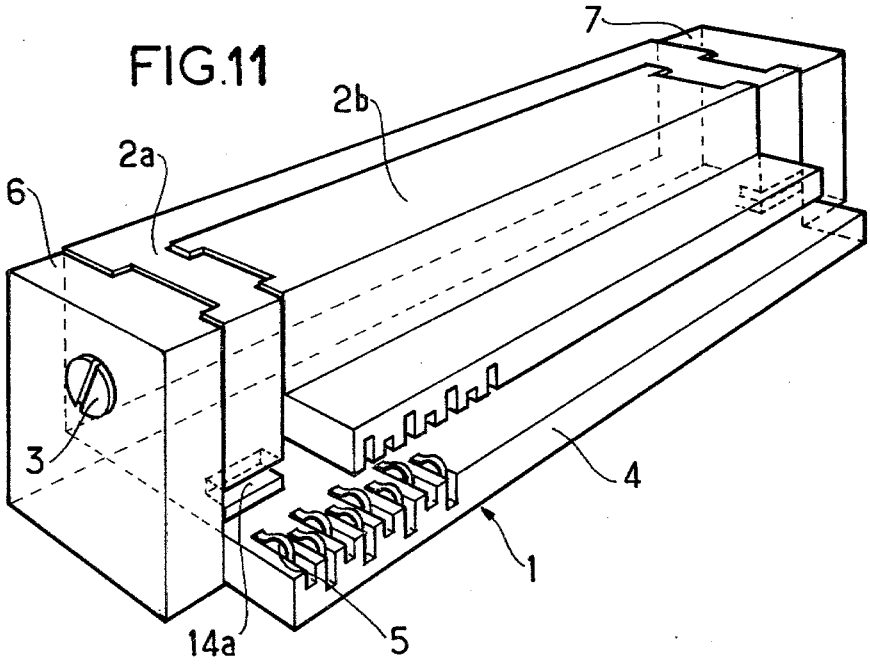
FIG. 11 is a perspective view of a connector according to an embodiment in which it is possible to make connections with the two faces of a board.
Figure 12:
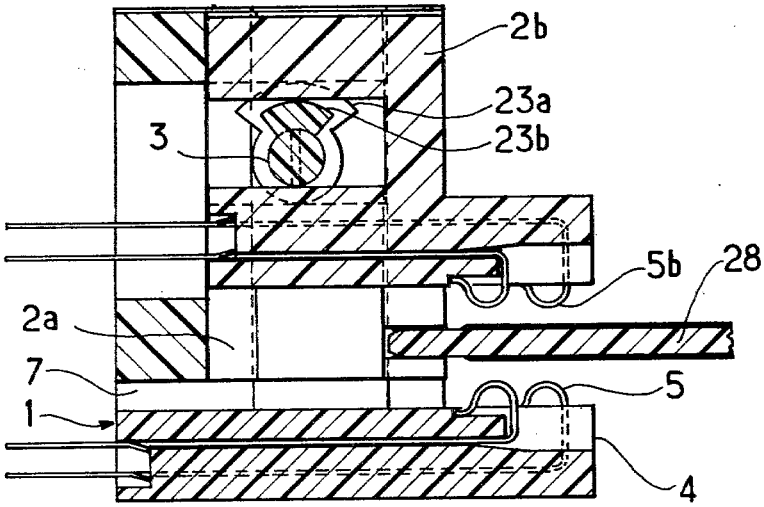
FIG. 12 is a cross-sectional view of the connector in FIG. 11.

FIGS. 11 and 12 show one variant of the connector described in FIGS. 1 to 3. This variant makes it possible to provide connection to a board which has contacts on two opposite sides.

As in FIG. 1, a baseplate 1 is provided which comprises a base portion 4 provided with contacts 5 and two uprights 6 and 7 each having a hole for the control shaft 3.

The movable block 2 used in the embodiment shown in FIGS. 1 to 3 is here made up by two parts, 2*a* and 2*b*; part 2*a* is slidably mounted between the uprights 6 and 7 and part 2*b* is slidably mounted within part 2*a*.

In this case board 28 is housed in a slot 14*a* provided in part 2*a*.

Part 2*b* carries contacts 5*b* which cooperate with the upper face of board 28, while contacts 5 cooperate with the lower face of the board.

Control shaft 3 carries two series of cams; one series, 23*a*, cooperates with part 2*a*, the other series 23*b*, cooperates with part 2*b*.

When control shaft 3 is turned, part 2*a* is first of all by cams 23*a* to establish electrical contact between the lower face of the circuit board 28 and the contacts 5. Then cams 23*b* move the part 2*b* and contact is made between the upper face of the circuit board 28 and the contacts 5*b*. To obtain such sequential operation, the cams 23*b* extend over a smaller arc than the cams 23*a*.

We claim:

1. A connector for a printed circuit board, said connector comprising;

a fixed baseplate including a base portion provided with contacts and including two uprights which are perpendicular to said base portion, one of said uprights including an open ended slot which is parallel to said base portion, a movable block slidable between said uprights and including a longitudinal slot on one side, said longitudinal slot extending parallel to said base portion, and a displacing device comprising a cam-bearing control shaft passing through said movable block and being received at each end, respectively, in holes within said uprights, and wherein said movable block is movable between two positions which are, respectively, raised and lowered with respect to said base portion such that when said movable block is in said raised position, an edge of the printed circuit board bearing contacts on its sides facing said base portion is insertable into said movable block without said circuit board contacts coming into contact with those of the base portion as the circuit board contacts pass over the contacts of the base portion, and a lowered position in which the printed circuit board contacts are pressed against the contacts on said base portion, said movable block carrying said printed circuit board with it as it moves, said open ended slot of said upright and said longitudinal slot in said movable block being aligned when said movable block is in the raised position, permitting a printed circuit board to be inserted into said connector by sliding it along the aligned slots, but said slot of said upright and said longitudinal slot being displaced to prevent said circuit board from being removed longitudinally from said slot in said movable block when said movable block is in the lowered position.

2. The connector according to claim 1 or claim 3, wherein said baseplate includes projections which engage with notches in said printed circuit board when said movable block is in the lowered position, in order to prevent extraction of said printed circuit board.

3. A connector for a printed circuit board, said connector comprising:

a base plate having a base portion provided with contacts and including a wall which is perpendicular to said base portion, said wall having a longitudinal slot which extends over the major portion of the length of the wall with said slot being closed at one end, a movable block comprising an elongated hollow member of rectangular cross-section, means for mounting said movable block within a fixed block formed by two parallel sidewalls which are joined at their ends by two uprights, one of said sidewalls including a sill along its entire length projecting away from the other sidewall, a displacing device comprising a cam-bearing control shaft, said shaft extending into said elongated hollow member and being received at each of its ends in respective holes in said uprights, and a printed circuit board fixed via one of its faces onto the bottom of said movable block such that said bottom is in direct flat contact with a corresponding portion of said face, the opposite face of said printed circuit board carrying contacts located below said movable block, said printed circuit board, said movable block and said fixed block constituting a contact-bearing member, said projecting sill being movable into said slot in said base plate when said shaft is rotated, such that said cams move said movable block to raised position, the contacts on said printed circuit board facing the contacts on said base portion and said movable block taking a lowered position due to the action of the cams when said control shaft is rotated; whereby the printed circuit board contacts are pressed against the contacts provided on said base portion.

4. The connector according to claim 3, wherein said control shaft includes a locking device at one end rotatable with said control shaft, said locking device being rotated to a position parallel to the wall of the base plate when said movable block is in raised position to allow longitudinal insertion of said contact-bearing member in the longitudinal slot of the wall until it comes into abutment with the end of the slot, and being rotated with the control shaft when the control shaft is rotated during moving of said block to the lowered position; whereby said locking device abuts against the end of the wall where said longitudinal slot is closed off, thereby preventing longitudinal extraction of the contact-bearing member in a direction toward the open end of said longitudinal slot.

5. The connector according to claim 3, wherein said slot in said baseplate includes at least one chamfered edge for facilitating broadside insertion of the sill on said fixed block.

6. A connector for a printed circuit board, comprising a fixed baseplate including a base portion provided with a first set of contacts, a movable block having a first part which is displaceable with respect to said base portion and a second part which is displaceable with respect to said first part and which carries a second set of contacts, said board being rigidly fixed to said first part, said connector further comprising means for successively displacing said first part in order to bring a first face of said board into contact with said first set of contacts and then said second part for bringing said second set of contacts into contact with a second face of said board.

7. The connector according to claim 6, wherein the means for successively displacing said first and second parts comprises a control shaft provided with two sets of cams.

* * * * *